US010720696B2

(12) United States Patent
Wu et al.

(10) Patent No.: US 10,720,696 B2
(45) Date of Patent: Jul. 21, 2020

(54) ELECTRONIC DEVICES WITH ENHANCED ANTENNA PERFORMANCE

(71) Applicant: Guangdong Oppo Mobile Telecommunications Corp., Ltd., Dongguan, Guangdong (CN)

(72) Inventors: Qing Wu, Guangdong (CN); Haijun Tang, Guangdong (CN); Huanhong Liu, Guangdong (CN); Guolin Liu, Guangdong (CN)

(73) Assignee: GUANGDONG OPPO MOBILE TELECOMMUNICATIONS CORP., LTD., Dongguan (CN)

( * ) Notice: Subject to any disclaimer, the term of this patent is extended or adjusted under 35 U.S.C. 154(b) by 42 days.

(21) Appl. No.: 16/196,843

(22) Filed: Nov. 20, 2018

(65) Prior Publication Data

US 2019/0207300 A1 Jul. 4, 2019

(30) Foreign Application Priority Data

Dec. 29, 2017 (CN) ..... 2017 1 1499644
Dec. 29, 2017 (CN) ..... 2017 2 1927735 U

(51) Int. Cl.
*H01Q 1/24* (2006.01)
*H01Q 1/44* (2006.01)
(Continued)

(52) U.S. Cl.
CPC ..... *H01Q 1/244* (2013.01); *H01Q 1/20* (2013.01); *H01Q 1/243* (2013.01); *H01Q 1/44* (2013.01);
(Continued)

(58) Field of Classification Search
CPC ..... H01Q 1/24; H01Q 1/242; H01Q 1/244; H01Q 1/20; H01Q 9/0407
See application file for complete search history.

(56) References Cited

U.S. PATENT DOCUMENTS

2014/0323063 A1 10/2014 Xu et al.
2017/0142241 A1* 5/2017 Kim ..... H01Q 5/385

FOREIGN PATENT DOCUMENTS

CN 2809942 Y 8/2006
CN 104466575 A 3/2015
(Continued)

OTHER PUBLICATIONS

Extended European search report issued in corresponding European application No. 18206457.6 dated May 27, 2019.
(Continued)

*Primary Examiner* — Hoang V Nguyen

(57) ABSTRACT

An electronic device is provided. The electronic device includes a metal frame, a circuit board, a first connection structure, and an antenna module. The metal frame is provided with a first contact portion extending outwardly from an inner surface of the metal frame. The first connection structure includes a first resilient piece, the first resilient piece has a first end and a second end opposite to the first end, the first end of the resilient piece is electrically coupled with the first contact portion via abutting against the first contact portion. The antenna module disposed on the circuit board is electrically coupled with the second end of the first resilient piece extending through the circuit board, and is electrically coupled with the metal frame via the first resilient piece, such that the metal frame is operable to be antenna resonating elements of the antenna module.

19 Claims, 4 Drawing Sheets

(51) Int. Cl.

| | |
|---|---|
| ***H01Q 1/20*** | (2006.01) |
| ***H01Q 9/04*** | (2006.01) |
| *H01R 12/72* | (2011.01) |
| *H01R 13/24* | (2006.01) |

(52) U.S. Cl.
CPC ..... *H01Q 9/0407* (2013.01); *H01R 12/728* (2013.01); *H01R 13/2442* (2013.01)

(56) References Cited

FOREIGN PATENT DOCUMENTS

| | | | |
|---|---|---|---|
| CN | 104471789 | A | 3/2015 |
| CN | 104882663 | A | 9/2015 |
| CN | 204668452 | U | 9/2015 |
| CN | 206003955 | U | 3/2017 |
| CN | 106887695 | A | 6/2017 |
| CN | 206259517 | U | 6/2017 |
| CN | 206401517 | U | 8/2017 |
| CN | 107369885 | A | 11/2017 |
| CN | 206639952 | U | 11/2017 |

OTHER PUBLICATIONS

International search report issued in corresponding international application No. PCT/CN2018/115220 dated Jan. 30, 2019.

* cited by examiner

ELECTRONIC DEVICES WITH ENHANCED ANTENNA PERFORMANCE

CROSS-REFERENCE TO RELATED APPLICATION(S)

This application claims priority to Chinese Patent Application Serial No. 201721927735.4, filed on Dec. 29, 2017, and Chinese Patent Application No. 201711499644.X, filed on Dec. 29, 2017, the disclosures of both of which are hereby incorporated by reference in their entireties.

TECHNICAL FIELD

This disclosure relates to electronic devices, and particularly to electronic devices with enhanced antenna performance.

BACKGROUND

With the development of intelligent mobile terminals, the use of mobile networks becomes more and more frequent, thus it is necessary for the mobile terminals to provide stable and reliable signals. Signal stability of the mobile terminal depends on antenna performance, and stability of the antenna performance in turn depends on reliability of an antenna feed mode.

As screen occupation ratio is getting increasingly high, especially in a full screen recently emerged, an antenna clearance area is reduced to be small. Since the antenna performance is extremely sensitive to an environment (such as a feed position) of the antenna clearance area, how to perform antenna feed to ensure good antenna performance or improve the antenna performance has become a problem to be solved.

SUMMARY

Implementations of the present disclosure provide an electronic device with enhanced antenna performance.

According to a first aspect of the implementations of the present disclosure, an electronic device with enhanced antenna performance is provided. The electronic device includes a metal frame, a circuit board, a first connection structure, and an antenna module. The metal frame is provided with a first contact portion extending outwardly from an inner surface of the metal frame. The first connection structure includes a first resilient piece, which has a first end and a second end opposite to the first end, the first end of the resilient piece is electrically coupled with the first contact portion via abutting against the first contact portion. The antenna module is disposed on the circuit board. The antenna module is electrically coupled with the second end of the first resilient piece extending through the circuit board and electrically coupled with the metal frame via the first resilient piece, such that the metal frame is operable to be antenna resonating elements of the antenna module.

According to a second aspect of the implementations of the present disclosure, an electronic device with enhanced antenna performance is provided. The electronic device includes a metal frame, a circuit board, a connection structure, and an antenna module. The metal frame is provided with a contact portion extending outwardly from an inner surface of the metal frame. The connection structure extends through the circuit board, and has a first end and a second end opposite to the first end, and the first end is electrically coupled with the contact portion via abutting against the contact portion. The antenna module is disposed on the circuit board, and the antenna module is electrically coupled with the second end of the connection structure and electrically coupled with the metal frame via the connection structure, such that the metal frame is operable to be antenna resonating elements of the antenna module.

According to a third aspect of the implementations of the present disclosure, an electronic device with enhanced antenna performance is provided. The electronic device includes a metal frame, a circuit board, an antenna module, and a connection structure. The antenna module is disposed on the circuit board. The connection structure extends through the circuit board and electrically coupled with the metal frame and the antenna module, such that the metal frame is operable to be antenna resonating elements of the antenna module.

BRIEF DESCRIPTION OF THE DRAWINGS

To illustrate the technical solutions embodied by the implementations of the present disclosure more clearly, the following briefly introduces the accompanying drawings required for describing the implementations. Apparently, the accompanying drawings in the following description merely illustrate some implementations of the present disclosure. Those of ordinary skill in the art may also obtain other drawings based on these accompanying drawings without creative efforts.

DETAILED DESCRIPTION

Figure 1:
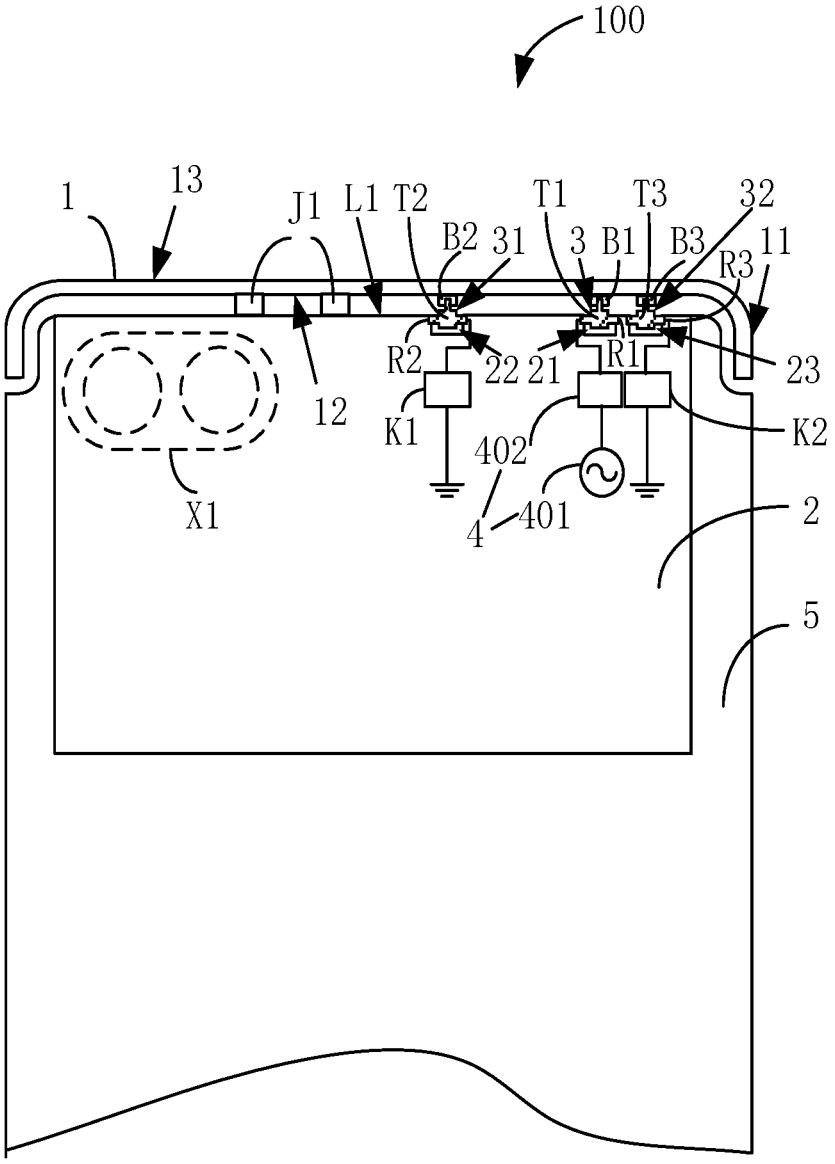
FIG. 1 is a schematic top view illustrating a part of an internal structure of an electronic device according to one implementation of the present disclosure.

Technical solutions in implementations of the present disclosure will be described clearly and completely hereinafter with reference to the accompanying drawings in the implementations of the present disclosure. Apparently, the described implementations are merely some rather than all implementations of the present disclosure. All other implementations obtained by those of ordinary skill in the art based on the implementations of the present disclosure without creative efforts shall fall within the protection scope of the present disclosure.

It should be understood that, relationships of orientations or positions indicated by terms such as "upward" and "downward" are based on that illustrated in the accompanying drawings according to the implementations of the present disclosure, and merely to facilitate the description of the present disclosure and simplify the description rather than to suggest or indicate that devices or elements referred to must have particular orientations and be constructed and operated in particular orientations, and therefore is not to be construed as a limitation of the present disclosure. The terms such as "first" and "second" are used for distinguishing between different objects rather than describing a particular order.

According to a first aspect of implementations of the present disclosure, an electronic device with enhanced antenna performance is provided. The electronic device includes a metal frame, a circuit board, a first connection structure, and an antenna module. The metal frame is provided with a first contact portion extending outwardly from an inner surface of the metal frame. The first connection structure includes a first resilient piece, which has a first end and a second end opposite to the first end, the first end of the resilient piece is electrically coupled with the first contact portion via abutting against the first contact portion. The antenna module is disposed on the circuit board. The antenna module is electrically coupled with the second end of the first resilient piece extending through the circuit board and electrically coupled with the metal frame via the first resilient piece, such that the metal frame is operable to be antenna resonating elements of the antenna module.

In one implementation, the circuit board is disposed close to the first contact portion of the metal frame, and the circuit board and the first contact portion define a height difference therebetween. The antenna module is disposed on a first surface of the circuit board away from the first contact portion. The first resilient piece further has a body connected between the first end and the second end, the body of the first resilient piece extends from the first end to the second end via extending into a second surface of the circuit board opposite to the first surface and extending out of the first surface of the circuit board. The first end of the first resilient piece abuts against the first contact portion, and the second end of the first resilient piece is fixed on the first surface of the circuit board and electrically coupled with the antenna module disposed on the first surface of the circuit board.

In one implementation, a side of the circuit board close to the first contact portion of the metal frame defines a first cutout, the first cutout is positioned correspondingly to the first contact portion, and the first resilient piece extends through the circuit board via the first cutout.

In one implementation, the second end of the first resilient piece is in a flat plate shape, the body of the first resilient piece is coupled with a side of the second end close to the metal frame, each of two opposite sides of the second end adjacent to the side of the second end close to the metal frame is provided with a protruding portion extending outwardly in a direction parallel to the side of the second end close to the metal frame, and each of the two protruding portions is fixed on the first surface of the circuit board via extending out from the first cutout.

In one implementation, the first end of the first resilient piece is a bending end extending away from the first contact portion by a distance, and a bending top of the first end contacts with the first contact portion.

In one implementation, the bending top of the first end abutting against the first contact portion is subjected to a surface roughening treatment to increase a closeness of contact between the first end and the first contact portion.

In one implementation, the first contact portion is a step-shaped structure extending from the inner surface of the metal frame, the first contact portion has a first stepped surface and a second stepped surface extending from the inner surface of the metal frame, a distance defined between the second stepped surface and the circuit board is larger than that between the first stepped surface and the circuit board, and the first end of the first resilient piece abuts against the second stepped surface.

In one implementation, the electronic device further includes a front shell and a display screen, the front shell is operable to support the display screen, the circuit board is disposed on a side of the front shell without supporting the display screen, and the front shell is operable to be a reference ground of the electronic device.

In one implementation, a thickness of a region of the front shell corresponding to the first resilient piece is less than an overall thickness of the front shell.

In one implementation, the front shell extends close to and is spaced apart from the metal frame, and the contact portion and front shell define a distance therebetween in a direction perpendicular to a display screen of the electronic device.

In one implementation, the electronic device further includes a second connection structure and a first grounding switch. The second connection structure includes a second resilient piece, the second resilient piece has a structure same as that of the first resilient piece, and the metal frame of the electronic device is further provided with a second contact portion extending outwardly from the inner surface of the metal frame. The first grounding switch is disposed on the circuit board, the second resilient piece extends through the circuit board, the second resilient piece has an end abutting against the second contact portion and has another end electronically coupled with the first grounding switch.

In one implementation, the electronic device further includes a third connection structure and a second grounding switch. The third connection structure includes a third resilient piece, the third resilient piece has a structure same as that of the first resilient piece, the metal frame of the electronic device is further provided with a third contact portion extending outwardly from the inner surface of the metal frame, and the third contact portion and the second contact portion are respectively disposed on opposite sides of the first contact portion. The second grounding switch is disposed on the circuit board, the third resilient piece extends through the circuit board, the third resilient piece has an end abutting against the third contact portion, and has another end electronically coupled with second grounding switch.

In one implementation, the electronic device further defines a second cutout and a third cutout, the second resilient piece extends through the circuit board via the second cutout, and the third resilient piece extends through the circuit board via the third cutout.

In one implementation, thicknesses of regions of the front shell corresponding to the second resilient piece and the third resilient piece are less than an overall thickness of the front shell.

In one implementation, the electronic device further includes at least one electronic connector electronically coupled with the front shell and the metal frame, and the at least one electronic connector is operable to divide the metal frame into at least two antenna resonating elements.

In one implementation, the antenna module is coupled with one of the at least two antenna resonating elements via the first contact portion, when the antenna module performs a feed excitation, the resonating element coupled with the antenna module is enabled to resonate in an antenna mode different from that in which the remaining of the at least two resonating elements resonates, such that the at least two antenna resonating elements resonate in different modes to produce a resonance.

In one implementation, the at least one electronic connector is fixed on and electronically coupled with the metal frame and the front shell by one manner of welding connection, screw connection, and snap-fit connection.

According to a second aspect of implementations of the present disclosure, an electronic device with enhanced antenna performance is provided. The electronic device includes a metal frame, a circuit board, a connection structure, and an antenna module. The metal frame is provided with a contact portion extending outwardly from an inner surface of the metal frame. The connection structure extends through the circuit board, and has a first end and a second end opposite to the first end, and the first end is electrically coupled with the contact portion via abutting against the contact portion. The antenna module is disposed on the circuit board, and the antenna module is electrically coupled with the second end of the connection structure and electrically coupled with the metal frame via the connection structure, such that the metal frame is operable to be antenna resonating elements of the antenna module.

In one implementation, the circuit board is disposed close to the contact portion of the metal frame, and the circuit board and the contact portion define a height difference therebetween. The antenna module is disposed on a first surface of the circuit board away from the contact portion. The connection structure further has a body connected between the first end and the second end, the body of the connection structure extends from the first end to the second end via extending into a second surface of the circuit board opposite to the first surface and extending out of the first surface of the circuit board. The first end of the connection structure abuts against the contact portion, and the second end of the connection structure is fixed on the first surface of the circuit board and electrically coupled with the antenna module disposed on the first surface of the circuit board.

According to a third aspect of implementations of the present disclosure, an electronic device with enhanced antenna performance is provided. The electronic device includes a metal frame, a circuit board, an antenna module, and a connection structure. The antenna module is disposed on the circuit board. The connection structure extends through the circuit board and electrically coupled with the metal frame and the antenna module, such that the metal frame is operable to be antenna resonating elements of the antenna module.

Figure 2:
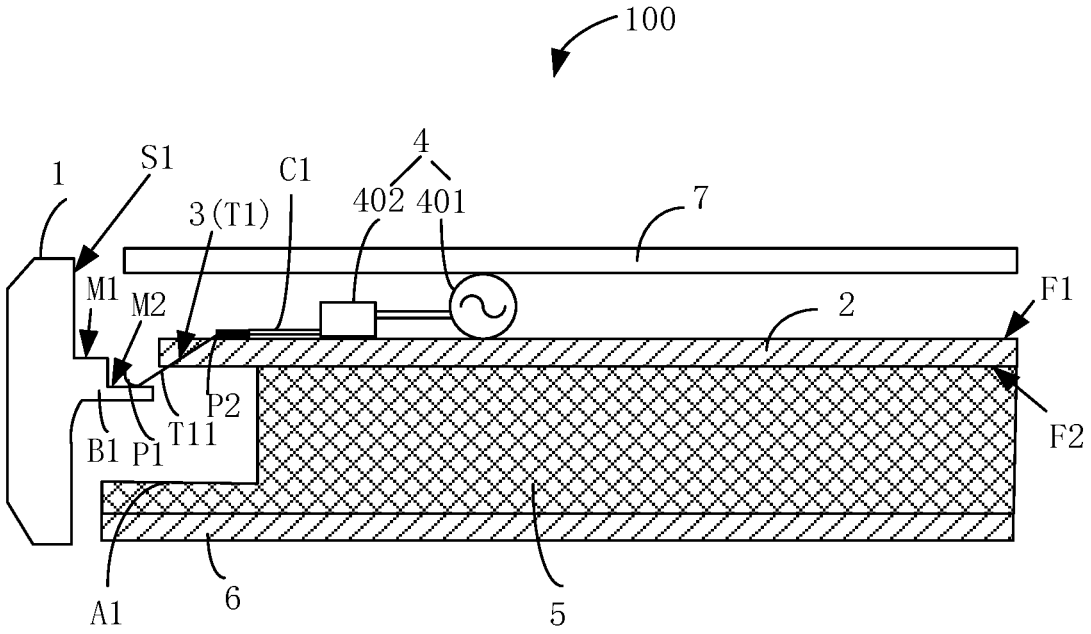
FIG. 2 is a schematic side view illustrating an electronic device including an antenna module according to one implementation of the present disclosure.

Referring to FIGS. 1-2, FIG. 1 is a schematic top view illustrating a part of an internal structure of an electronic device 100, and FIG. 2 is a schematic side view illustrating a part of the electronic device 100 including an antenna module 4 arranged therein. The electronic device 100 includes a metal frame 1, a circuit board 2, a connection structure 3, and an antenna module 4 disposed on the circuit board 2. The connection structure 3 electrically couples the metal frame 1 with the antenna module 4, such that the metal frame 1 is operable to be antenna resonating elements.

The metal frame 1 is provided with a first contact portion B1 extending outwardly from an inner surface S1 of the metal frame 1. The connection structure 3 includes a resilient piece T1, the resilient piece T1 has a first end P1 and a second end P2 opposite to the first end P1, and the first end P1 is electrically coupled with the contact portion B1 via abutting against the contact portion B1. The antenna module 4 disposed on the circuit board 2 is electrically coupled with the second end P2 of the resilient piece T1 extending through the circuit board 2, and is electrically coupled with the metal frame 1 via the resilient piece T1, such that the metal frame 1 is operable to be antenna resonating elements of the antenna module 4.

Compared with an antenna feed manner with a high assembly difficulty in which the resilient piece T1 is resiliently disposed facing a side of a circuit board, and an antenna feed manner with an extremely poor antenna performance due to a small antenna clearance area in which the resilient piece T1 is directly disposed on the circuit board 2, by means of the antenna feed manner in the present disclosure in which the resilient piece T1 directly extends through the circuit board 2, the assembly difficulty can be reduced and the radiation performance of the antenna module 4 can be improved in a case of a small clearance area, for example, a full screen.

As illustrated in FIG. 2, the circuit board 2 is disposed close to the contact portion B1 of the metal frame 1, and the circuit board 2 and the contact portion B1 define a height difference therebetween. The antenna module 4 is disposed on a first surface F1 of the circuit board 2 away from the contact portion B1. The resilient piece T1 further has a body T11 connected between the first end P1 and the second end P2, the first end P1 of the resilient piece T1 abuts against the contact portion B1, and the second end P2 of the resilient piece T1 is fixed on the first surface F1 of the circuit board 2 and electrically coupled with the antenna module 4 disposed on the first surface F1 of the circuit board 2. The body T11 of the resilient piece T1 extends from the first end P1 to the second end P2 via extending into a second surface F2 of the circuit board 2 opposite to the first surface F1 and extending out of the first surface F1 of the circuit board 2.

Figure 3:
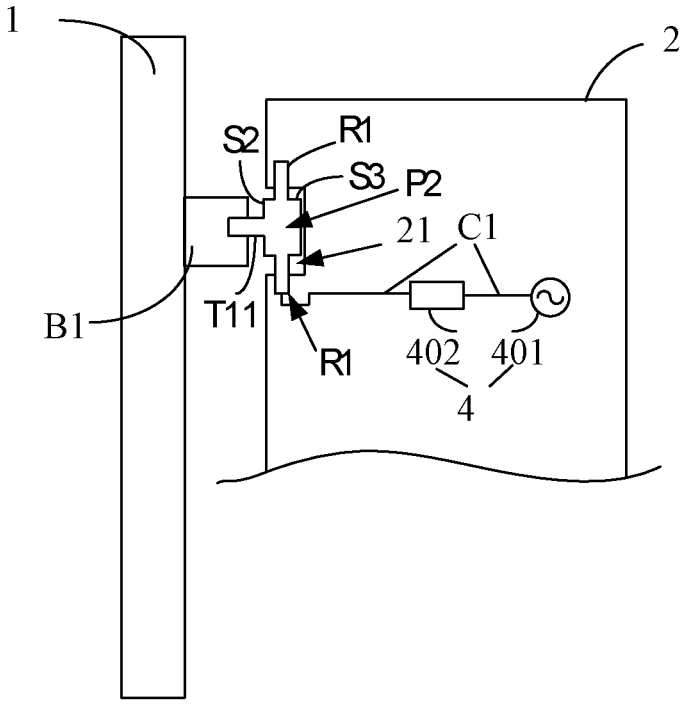
FIG. 3 is a schematic top view illustrating a partial region of an electronic device including an antenna module according to one implementation of the present disclosure.

FIG. 3 is a schematic top view illustrating a partial region of an electronic device 100 including the antenna module 4 arranged therein. In some implementations, a side L1 of the circuit board 2 close to the contact portion B1 of the metal frame 1 defines a cutout 21, the cutout 21 is positioned correspondingly to the contact portion B1, and the resilient piece T1 extends through the circuit board 2 via the cutout 21. The first end P1 of the resilient piece T1 abuts against the contact portion B1, and the second end P2 of the resilient piece T1 is fixed on the first surface F1 of the circuit board 2 and electrically coupled with the antenna module 4 disposed on the first surface F1 of the circuit board 2.

Figure 4:
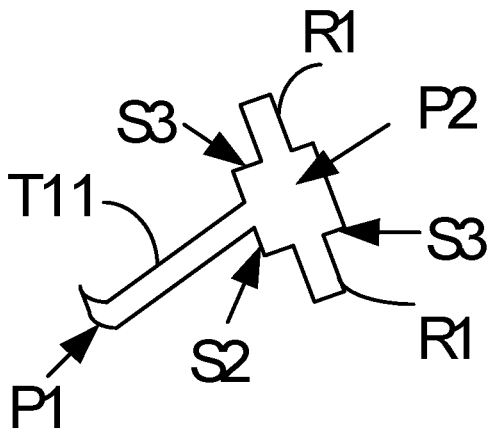
FIG. 4 is a schematic view illustrating a resilient piece according to one implementation of the present disclosure.

As illustrated in FIG. 1, FIG. 3 and FIG. 4, FIG. 4 is a schematic view of the resilient piece T1. In some implementations, the second end P2 of the resilient piece T1 is in a flat plate shape, the body T11 of the resilient piece T1 is connected to a side S2 of the second end P2 close to the metal frame 1. Each of two opposite sides S3 of the second end P2 adjacent to the side S2 of the second end P2 close to the metal frame 1 is provided with a protruding portion R1 extending outwardly in a direction parallel to the side S2 of the second end P2, and each of the two protruding portions R1 is fixed on the first surface F1 of the circuit board 2 via extending out from the first cutout 21.

As illustrated in FIG. 1 and FIG. 3, the two protruding portions R1 extend away from intermediate portions of the two opposite sides S3, and a width of each of the two protruding portions R1 is smaller than a length of each of the two opposite sides S3. The body T11 of the resilient piece T1 is connected to the intermediate portion of the side S2 close to the metal frame 1, and the width of the body T11 is also smaller than the length of the side S2 close to the metal frame 1.

In one implementation, the antenna module 4 is electronically coupled with one of the protruding portions R1 fixed on the first surface F1 of the circuit board 2.

The second end P2 is parallel to the circuit board 2, and the body T11 of the resilient piece T1 and the second end P2 define an angle therebetween. When assembling, a distance between the circuit board 2 and the contact portion B1 is set to a specific value, such that the resilient piece T1 has a certain resilient force when being fixed between the circuit board 2 and the contact portion B1, thereby ensuring that the resilient piece T1 is in close contact and electrical connection with the circuit board 2 and the contact portion B1.

In one implementation, the two protruding portions R1 of the second end P2 are fixed on the circuit board 2 by welding.

As illustrated in FIG. 2 and FIG. 4, in some implementations, the first end P1 of the resilient piece T1 is a bending end extending away from the contact portion B1 by a distance to form a hook, and the first end P1 contacts with the contact portion B1 at a bending top (that is, an apex portion of the bending end). Thus, the first end P1, i.e., the bending end, allows the resilient piece T1 to be moved relative to the contact portion B1, thereby ensuring a close contact and an electrical connection between the resilient piece T1 and the contact portion B1 when the electronic device 100 is subjected to shock and vibration due to dropping, shaking, or the like.

In one implementation, the bending top of the first end P1 abutting against the contact portion B1 is subjected to a surface roughening treatment to increase a closeness of contact between the first end P1 and the contact portion B1.

In one implementation, the body T11 of the resilient T1 of the body T11 may be formed in a substantially straight, bar shape.

As illustrated in FIG. 2, the electronic device 100 further includes a front shell 5 and a display screen 6, and the front shell 5 is operable to support the display screen 6. The circuit board 2 is disposed on a side of the front shell 5 without supporting the display screen 6. The front shell 5 is a metal casing and is operable to be a reference ground of the electronic device 100. The size of the circuit board 2 is smaller than that of the front shell 5, and the size of the display screen 6 is substantially equal to that of the front shell 5. FIG. 2 is a schematic side view of the electronic device 100 when the display screen 6 of the electronic device 100 faces downward. FIG. 1, FIG. 3 and the other top views are schematic top views of the electronic device 100 when the display screen 6 of the electronic device 100 faces downward.

The front shell 5 extends close to and is spaced apart from the metal frame 1, and the front shell 5 and the contact portion B1 define a certain distance therebetween in a direction perpendicular to the display screen 6. As illustrated in FIG. 2, the front shell 5 also extends at least partially below the contact portion B1 and the resilient piece T1 from the orientation illustrated in FIG. 2 and is spaced apart from the contact portion B1 and the resilient piece T1, such that at least a partial region A1 of the front shell 5 is positioned correspondingly to the resilient piece T1.

As illustrated in FIG. 2, the thickness of the partial region A1 of the front shell 5 corresponding to the resilient piece T1 is significantly smaller than the overall thickness of the front shell 5 (i.e., the thickness of most of the region of the front shell 5 that does not correspond to the resilient piece T1). The thickness of the partial region A1 of the front shell 5 corresponding to the resilient piece T1 occupies, for example, about a quarter, a third of the overall thickness of the front shell 5. In this way, a distance defined between the resilient piece T1 and the front shell 5 can be increased, and the radiation performance degradation of the antenna, caused by the energy consumption of the antenna due to the coupling between the resilient piece T1 and the front shell 5 acting as the reference ground of the electronic device 100, can be avoided.

The partial region A1 of the front shell 5 corresponding to the resilient piece T1 refers to a region of the front shell 5 where the projection of the resilient piece T1 is positioned, and the shape of the partial region A1 of the front shell 5 corresponding to the resilient piece T1 may be similar to the projection of the resilient piece T1 on the front shell 5. Alternatively, the partial region A1 of the front shell 5 corresponding to the resilient piece T1 may be a rectangular region including the region of the front shell 5 where the projection of the resilient piece T1 is positioned.

As illustrated in FIG. 2, the contact portion B1 is a step-shaped structure extending from the inner surface S1 of the metal frame 1. The contact portion B1 has a first stepped surface M1 and a second stepped surface M2 extending from the inner surface S1 of the metal frame 1. A distance defined between the second stepped surface M1 and the circuit board 2 is larger than that defined between the first stepped surface M2 and the circuit board 2. The first end P1 of the resilient piece T1 abuts against the second stepped surface M2, thus a tilt angle of the resilient piece T1 is large, and the size of the projection of the resilient piece T1 on the front shell 5 is small, thereby reducing a relative area of the resilient piece T1 opposed to the front shell 5 (that is, reducing a coupling area), and further decreasing the coupling between the resilient T1 and the front shell 5 acting as the reference ground of the electronic device 100.

As illustrated in FIG. 1, the electronic device 100 further includes a connection structure 31 and a connection structure 32, the connection structure 31 includes a resilient piece T2, and the connection structure 32 includes a resilient piece T3. The resilient piece T2, the resilient piece T3, and the resilient piece T1 have a same structure.

The metal frame 1 of the electronic device 100 is further provided with a contact portion B2 and a contact portion B3 extending outwardly from the inner surface S1 of the metal frame 1. The contact portion B2 and the contact portion B3 are arranged on two sides of the contact portion B1, respectively. The contact portion B2, the contact portion B3, and the contact portion B1 have a same structure.

As illustrated in FIG. 1, the electronic device 100 further includes a grounding switch K1 disposed on the circuit board 2 and a grounding switch K2 disposed on the circuit board 2.

The resilient piece T2 extends through the circuit board 2, has an end abutting against the contact portion B2, and has another end electronically coupled with the grounding switch K1. The resilient piece T3 extends through the circuit board 2, has an end abutting against the contact portion B3, and has another end electronically coupled with the grounding switch K2.

A feed length of the metal frame 1 acting as the antenna resonating elements of the antenna module 4 can be changed by switching an on-state and an off-state of at least one of the grounding switch K1 and the grounding switch K2 and is further adjusted through matching, thereby further improving the antenna performance.

The grounding switches K1 and K2 are electrically coupled with grounding points on the circuit board 2. The grounding points on the circuit board 2 may also be electrically coupled with the front shell 5 acting as the reference ground of the electronic device 100.

As illustrated in FIG. 1, the electronic device 100 further defines a cutout 22 and a cutout 23, the resilient piece T2 extends through the circuit board 2 via the second cutout 22, and the resilient piece T3 extends through the circuit board 2 via the cutout 23.

Figure 5:
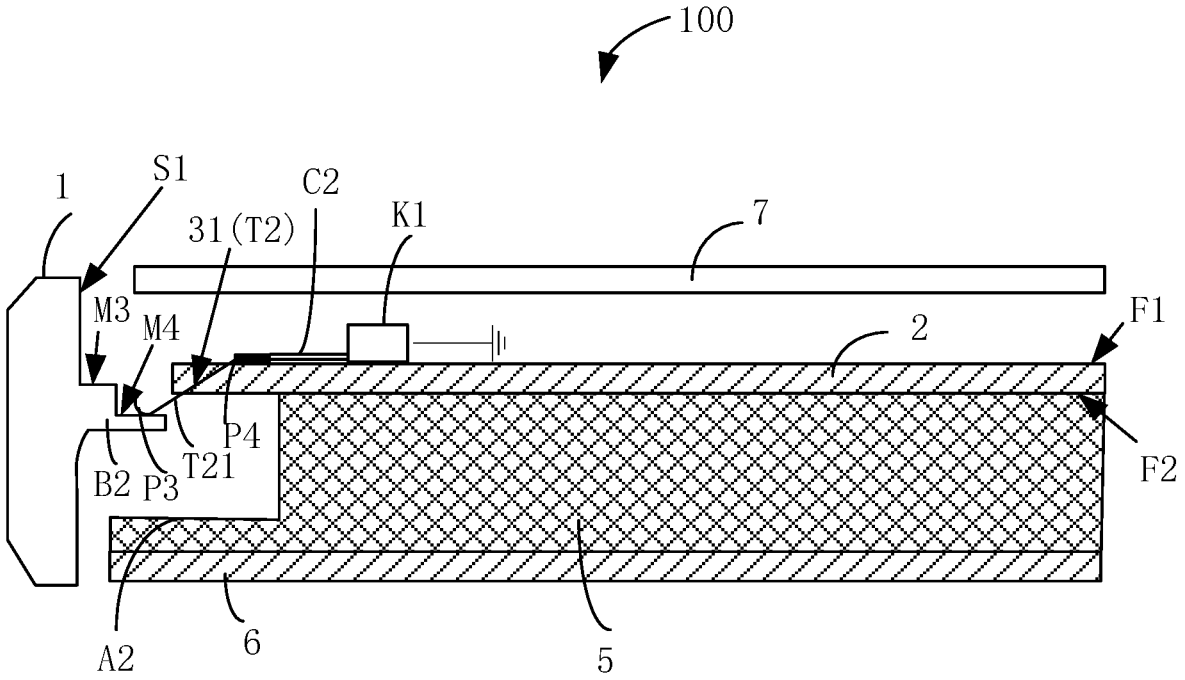
FIG. 5 is a schematic side view illustrating an electronic device including a grounding switch according to one implementation of the present disclosure.

FIG. 5 is a schematic side view of the electronic device 100 illustrating a grounding switch. Since the connection structure 32 and the connection structure 31 have a same structure, the grounding switch K2 and the grounding switch K1 have a same structure, and a connection between the connection structure 32 and the grounding switch K2 is the same as that between the connection structure 31 and the grounding switch K1, the connection between the connection structure 31 and the grounding switch K1 on the circuit board 2 will be described as an example.

As illustrated in FIG. 5, the resilient piece T2 has a body T21, a first end P3, and a second end P4. The first end P3 of the resilient piece T2 abuts against the contact portion B2, and the second end P4 of the resilient piece T2 is fixed on the first surface F1 of the circuit board 2 and is electrically coupled with the grounding switch K1 on the first surface F1 of the circuit board 2. The grounding switch K1 is connected with the second end P4 via a wire C2. The body T21 of the resilient piece T2 extends through the circuit board 2 via the corresponding cutout 22.

As illustrated in FIG. 5, the contact portion B2 is also a step-shaped structure extending from the inner surface S1 of the metal frame 1, the contact portion B2 has a first stepped surface M3 and a second stepped surface M4 extending from the inner surface S1 of the metal frame 1, a distance defined between the second stepped surface M4 and the circuit board 2 is larger than that defined between the first stepped surface M3 and the circuit board 2, and the first end P3 of the first resilient piece T2 abuts against the second stepped surface M4.

The area of the second stepped surface M2 of the contact portion B1 is larger than that of the first end of the resilient pieces T1, and the area of the second stepped surface M4 of the contact portion B2 is larger than that of the first end of the resilient pieces T2, thereby ensuring that the first ends of the resilient pieces T1, T2 can be moved within a certain region with a close contact with the contact portions B1, B2.

Figure 6:
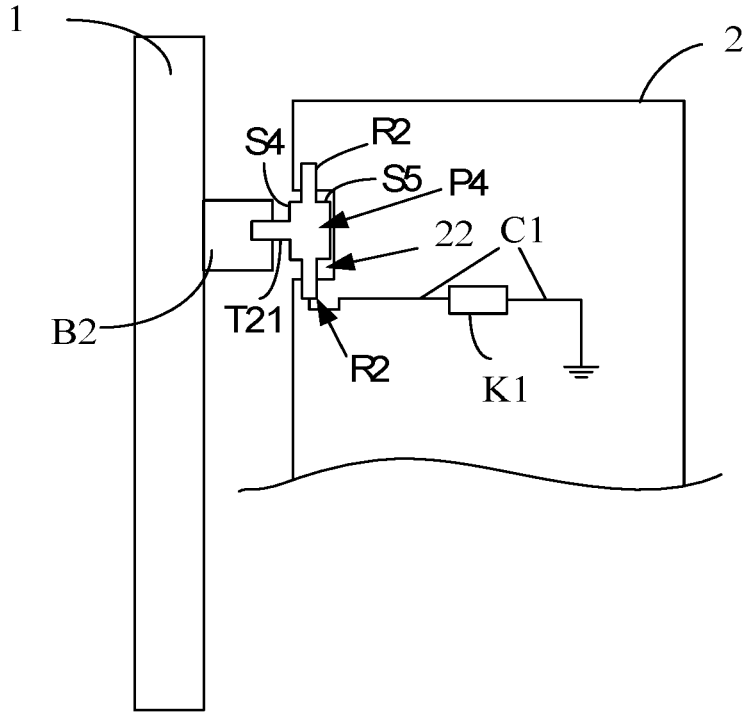
FIG. 6 is a schematic top view illustrating a partial region of an electronic device including a grounding switch according to one implementation of the present disclosure.

FIG. 6 is a schematic top view of the electronic device 100 illustrating the grounding switch K1. As illustrated in FIG. 6, the second end P4 of the resilient piece T2 is in a flat plate shape, the body T21 of the resilient piece T2 is connected to a side S4 of the second end P4, two opposite sides S5 of the second end P4 adjacent to the side S4 of the second end P4 are respectively provided with a protruding portion R2 extending outwardly in a direction parallel to the side S4 of the second end P4, and each of the two protruding portions R2 is fixed on the first surface F1 of the circuit board 2 via extending out from the cutout 22.

The grounding switch K1 is electronically coupled with one of the two protruding portions R2 of the second end P4 of the resilient piece T2, and the one of the two protruding portions R2 is fixed on the first surface F1 of the circuit board 2.

The second end P4 of the resilient piece T2 is parallel to the circuit board 2. The body T21 of the resilient piece T2 and the second end P4 defines an angle therebetween.

The two protruding portions R2 of the second end P4 of the resilient piece T2 are fixed on the circuit board 2 by welding.

As illustrated in FIG. 5, a region A2 of the front shell 5 corresponding to the resilient piece T2 has been thinned via a thinning process, and a region (not illustrated) of the front shell 5 corresponding to the resilient piece T3 has also been thinned via a thinning process. Thus the thicknesses of the regions of the front shell 5 corresponding to the resilient pieces T2, T3 are less than the overall thickness of the front shell 5. Therefore, regions of the front shell 5 corresponding to the resilient pieces T1, T2, and T3 have been thinned via thinning processes. In this way, the distances defined between any of the resilient pieces T1, T2, and T3 and the front shell 5 can be increased, and the radiation performance degradation of the antenna, caused by the energy consumption of the antenna due to the coupling between the resilient pieces T1, T2, T3 and the front shell 5 acting as the reference ground of the electronic device 100, can be avoided.

Similarly, the first end P3 of the resilient piece T2 is also a bending end extending away from the contact portion B2 by a distance to form a hook, and the first end P3 contacts with the contact portion B2 at a bending top (that is, an apex portion of the bending end). Similarly, in some implementations, the bending top of the first end P3 abutting against the contact portion B2 is subjected to a surface roughening treatment to increase a closeness of contact between the first end P3 and the contact portion B2.

Referring back to FIG. 1, the electronic device 100 further includes at least one electronic connector J1 electronically coupled with the front shell 5 and the metal frame 1, and the at least one electronic connector J1 is operable to divide the metal frame 1 into at least two antenna resonating elements.

In some implementations, the at least one electronic connector J1 is fixed on and electronically coupled with the metal frame 1 and the front shell 5 by welding connection, screw connection, or snap-fit connection. The at least one electronic connector J1 may be a metal piece.

The antenna module 4 is coupled with one of the antenna resonating elements via the connection structure 3. When the antenna module 4 performs a feed excitation, the resonating element coupled with the antenna module 4 is enabled to resonate in an antenna mode different from in which the remaining of the antenna resonating elements resonates, such that the antenna resonating elements resonate in different antenna modes to produce a resonance, thereby increasing a bandwidth of a particular frequency band.

As illustrated in FIG. 1, two electronic connectors J1 are provided, and connection positions of the two electronic connectors J1 are positioned on the same side of the contact portions B1, B2, B3 of the metal frame 1.

The two electronic connectors J1 divide the metal frame 1 into at least a first antenna resonating element 11, a second antenna resonating element 12, and a third antenna resonating element 13. The contact portions B1, B2, and B3 are all positioned on the first antenna resonating element 11. The antenna module 4, the grounding switch K1, and the grounding switch K2 are respectively coupled with the first antenna resonating element 11 through a corresponding connection structure.

The antenna module 4 is coupled with one of the antenna resonating elements via the connection structure 3. When the antenna module 4 performs a feed excitation, the three antenna resonating elements are enabled to resonate in different antenna modes to produce a resonance, thereby increasing a bandwidth of a particular frequency band.

Therefore, the antenna performance can be further improved by arranging the at least one electronic connector J1 electrically coupled between the metal frame 1 and the front shell 5.

As illustrated in FIG. 1 and FIG. 2, the antenna module 4 includes a radio frequency source 401 and a matching circuit 402. The matching circuit 402 is electrically coupled between the second end P2 of the resilient piece T1 and the radio frequency source 401. The radio frequency source 401 is operable to generate feed excitation signals. The matching circuit 402 performs the matching adjustment on the feed excitation signals, and then performs feed excitation on the metal frame 1 acting as the antenna resonating elements through the corresponding resilient piece T1 to generate antenna radiation signals. As illustrated in FIG. 2, the radio frequency source 401 is electrically coupled with the matching circuit 402 via the wire C1, and the matching circuit 402 is electrically coupled with the second end P2 of the resilient piece T1 via the wire C1.

The grounding switches K1 and K2 may be numerical control switches, or may be switches such as metal oxide semiconductor (MOS) transistors and bipolar junction transistors (BJT).

As illustrated in FIG. 2, the electronic device 100 further includes a rear casing 7, and the rear casing 7 is disposed facing a side of the circuit board 2 away from the front shell 5. The rear casing 7 serves as a battery back cover to cover the back of the electronic device 100.

As illustrated in FIG. 1, the rear casing 7 defines a camera hole X1, and the camera hole X1 is a dual camera hole for accommodating a dual camera structure with two cameras. Alternatively, the camera hole X1 is a pseudo-dual-camera hole for accommodating a para-dual-camera structure with a camera and a flashlight.

The camera hole X1 is positioned at a corner position of the rear casing 7, and for example, as illustrated in FIG. 1, the projection of the camera hole X1 on the front shell 5 is also positioned at a corner position of the front shell 5.

In one implementation, the contact portions B1, B2, and B3 may be integrally formed with the metal frame 1, and alternatively, may be metal members fixed on the inner surface S1 of the metal frame 1 by welding.

In one implementation, the first end, the second end, and the body of the aforementioned resilient pieces T1, T2, and T3 are integrally formed structures.

In some implementations, the first end and the body of the aforementioned resilient pieces T1, as well as the resilient pieces T2 and T3, are integrally formed, and the second end and the body of the aforementioned resilient pieces T1, as well as the resilient pieces T2 and T3, are connected with each other by welding. The cutouts 21, 22 and 23 of the circuit board 2 may also be through holes. The bodies of the resilient pieces T1, T2, and T3 respectively extend through corresponding through holes and are respectively connected to corresponding second ends by welding, thereby avoiding the damage to large regions of the circuit board 2 and increasing the available area of the circuit board 2.

In some implementations, the aforementioned contact portions B1, B2, B3 may also be metal plates perpendicular to the inner surface S1 of the metal frame 1. The contact portions B1, B2, and B3 extend from a portion of the inner surface S1 of the metal frame 1 farther from the circuit board 2. Thus, a requirement of a large height difference between the contact portion B1 and the circuit board 2 can also be satisfied, such that the sizes of the projections of the resilient pieces T1, T2, and T3 on the front shell 5 are small.

The first end and the second end of the resilient piece T1, as well as the resilient pieces T2 and T3, may be in other shapes as long as they are in close contact with corresponding contact portions and are electrically coupled with the components on the circuit board 2.

The electronic device 100 may be a mobile phone or a tablet computer. The display screen 6 may be a touch display screen.

For the electronic device 100 with enhanced antenna performance provided by the present disclosure, the metal frame 1 is electrically coupled with the antenna module 4 disposed on the circuit board 2 via the connection structure 3 which includes the resilient piece T1, such that the metal frame 1 can act as the third antenna resonating element 13. In addition, the resilient piece T1 is connected to the antenna module 4 on the circuit board 2 by extending through the circuit board 2, thereby reducing the assembly difficulty, and effectively improving the radiation performance of the antenna module 4 when the clearance area is small.

The above descriptions are implementations of implementations according to the present disclosure. It should be noted that, as will occur to those skilled in the art, the present disclosure is susceptible to various modifications and polishes without departing from the spirit and principle of the present disclosure. These improvements and polishes shall be construed to be the protection scope of the present disclosure.

What is claimed is:

1. An electronic device with enhanced antenna performance, comprising:

a metal frame provided with a first contact portion extending outwardly from an inner surface of the metal frame;

a circuit board;

a first connection structure comprising a first resilient piece, the first resilient piece having a first end and a second end opposite to the first end, the first end of the first resilient piece being electrically coupled with the first contact portion via abutting against the first contact portion; and an antenna module disposed on the circuit board, the antenna module being electrically coupled with the second end of the first resilient piece extending through the circuit board, and being electrically coupled with the metal frame via the first resilient piece, such that the metal frame is operable to be antenna resonating elements of the antenna module;

wherein the first contact portion is a step-shaped structure extending from the inner surface of the metal frame, the first contact portion has a first stepped surface and a second stepped surface extending from the inner surface of the metal frame, a distance defined between the second stepped surface and the circuit board is larger than that defined between the first stepped surface and the circuit board, and the first end of the first resilient piece abuts against the second stepped surface.

2. The electronic device of claim 1, wherein the circuit board is disposed close to the first contact portion of the metal frame, and the circuit board and the first contact portion define a height difference therebetween;

the antenna module is disposed on a first surface of the circuit board away from the first contact portion;

the first resilient piece further has a body connected between the first end and the second end, the body of the first resilient piece extends from the first end to the second end via extending into a second surface of the circuit board opposite to the first surface and extending out of the first surface of the circuit board; and the first end of the first resilient piece abuts against the first contact portion, and the second end of the first resilient piece is fixed on the first surface of the circuit board and electrically coupled with the antenna module disposed on the first surface of the circuit board.

3. The electronic device of claim 2, wherein a side of the circuit board close to the first contact portion of the metal frame defines a first cutout, the first cutout is positioned correspondingly to the first contact portion, and the first resilient piece extends through the circuit board via the first cutout.

4. The electronic device of claim 3, wherein the second end of the first resilient piece is in a flat plate shape, the body of the first resilient piece is coupled with a side of the second end close to the metal frame, each of two opposite sides of the second end adjacent to the side of the second end close to the metal frame is provided with a protruding portion extending outwardly in a direction parallel to the side of the second end close to the metal frame, and each of the protruding portions is fixed on the first surface of the circuit board via extending out from the first cutout.

5. The electronic device of claim 3, wherein the first end of the first resilient piece is a bending end extending away from the first contact portion by a distance, and a bending top of the first end contacts with the first contact portion.

6. The electronic device of claim 1, further comprising a front shell and a display screen, the front shell being operable to support the display screen, the circuit board being disposed on a side of the front shell without supporting the display screen, and the front shell being operable to be a reference ground of the electronic device.

7. The electronic device of claim 6, wherein a thickness of a region of the front shell corresponding to the first resilient piece is smaller than a maximum thickness of the front shell.

8. The electronic device of claim 7, further comprising at least one electronic connector electronically coupled with the front shell and the metal frame, and the at least one electronic connector being operable to divide the metal frame into at least two antenna resonating elements.

9. The electronic device of claim 8, wherein the antenna module is coupled with one of the at least two antenna resonating elements via the first contact portion, when the antenna module performs a feed excitation, the resonating element coupled with the antenna module is enabled to resonate in an antenna mode different from that in which the remaining of the at least two antenna resonating elements resonates, such that the at least two antenna resonating elements resonate in different antenna modes to produce a resonance.

10. The electronic device of claim 9, wherein the at least one electronic connector is fixed on and electronically coupled with the metal frame and the front shell.

11. The electronic device of claim 6, wherein the front shell extends close to and is spaced apart from the metal frame, and the first contact portion and the front shell define a distance therebetween in a direction perpendicular to the display screen of the electronic device.

12. The electronic device of claim 6, further comprising:

a second connection structure comprising a second resilient piece, the second resilient piece having a structure same as that of the first resilient piece, the metal frame of the electronic device being further provided with a second contact portion extending outwardly from the inner surface of the metal frame; and a first grounding switch disposed on the circuit board, the second resilient piece extending through the circuit board, the second resilient piece having an end abutting against the second contact portion and having another end electronically coupled with the first grounding switch.

13. The electronic device of claim 12, further comprising:

a third connection structure, the third connection structure comprising a third resilient piece, the third resilient piece having a structure same as that of the first resilient piece, the metal frame of the electronic device being further provided with a third contact portion extending outwardly from the inner surface of the metal frame, and the third contact portion and the second contact portion are respectively disposed on opposite sides of the first contact portion; and a second grounding switch disposed on the circuit board, the third resilient piece extending through the circuit board, the third resilient piece having an end abutting against the third contact portion and having another end electronically coupled with the second grounding switch.

14. The electronic device of claim 13, further defining a second cutout and a third cutout, the second resilient piece extending through the circuit board via the second cutout, and the third resilient piece extending through the circuit board via the third cutout.

15. The electronic device of claim 13, wherein thicknesses of regions of the front shell corresponding to the second resilient piece and the third resilient piece are smaller than a maximum thickness of the front shell.

16. An electronic device with enhanced antenna performance, comprising:

a metal frame provided with a contact portion extending outwardly from an inner surface of the metal frame;

a circuit board;

a connection structure extending through the circuit board and comprising a resilient piece, the resilient piece having a first end and a second end opposite to the first end, the first end electrically coupled with the contact portion via abutting against the contact portion;

an antenna module disposed on the circuit board, the antenna module being electrically coupled with the second end of the connection structure and electrically coupled with the metal frame via the connection structure, such that the metal frame is operable to be antenna resonating elements of the antenna module; and a front shell and a display screen, wherein the front shell is operable to support the display screen, the circuit board is disposed on a side of the front shell without supporting the display screen, the front shell is operable to be a reference ground of the electronic device, and a thickness of a region of the front shell corresponding to the resilient piece is smaller than a maximum thickness of the front shell.

17. The electronic device of claim 16, wherein the circuit board is disposed close to the contact portion of the metal frame, and the circuit board and the contact portion define a height difference therebetween;

the antenna module is disposed on a first surface of the circuit board away from the contact portion;

the connection structure further has a body connected between the first end and the second end, the body of the connection structure extends from the first end to the second end via extending into a second surface of the circuit board opposite to the first surface and extending out of the first surface of the circuit board; and the first end of the connection structure abuts against the contact portion, and the second end of the connection structure is fixed on the first surface of the circuit board and electrically coupled with the antenna module.

18. The electronic device of claim 16, wherein a side of the circuit board close to the contact portion of the metal frame defines a cutout, the cutout is positioned correspondingly to the contact portion, and the connection structure extends through the circuit board via the cutout.

19. An electronic device with enhanced antenna performance, comprising:

a metal frame provided with a contact portion extending outwardly from an inner surface of the metal frame;

a circuit board;

an antenna module disposed on the circuit board; and a connection structure comprising a resilient piece extending through the circuit board and electrically coupled with the metal frame and the antenna module, such that the metal frame is operable to be antenna resonating elements of the antenna module;

a side of the circuit board close to the contact portion of the metal frame defining a cutout, the cutout being positioned correspondingly to the contact portion, and the resilient piece extending through the circuit board via the cutout.

* * * * *